US005590882A

United States Patent [19]

Todd

[11] Patent Number: 5,590,882

[45] Date of Patent: Jan. 7, 1997

[54] DIAGNOSTIC APPARATUS FOR GOLFCLUB SWING PRACTICE

[76] Inventor: John M. Todd, 7866 Hillary Dr., West Hills, Calif. 91304

[21] Appl. No.: 461,433

[22] Filed: Jun. 5, 1995

[51] Int. Cl.[6] ..... A63B 69/36

[52] U.S. Cl. ..... 473/218; 473/226; 473/266; 473/278

[58] Field of Search ..... 273/186.1, 186.2, 273/186.3, 186.4, 195 R, 195 A, 187 R, 187 A, 187.1, 194 A

[56] References Cited

U.S. PATENT DOCUMENTS

| | | | |
|---|---|---|---|
| 3,348,847 | 10/1967 | Fischl | 273/186.1 |
| 4,130,283 | 12/1978 | Lindquist | 273/195 A |
| 4,164,352 | 8/1979 | O'Brien | 273/195 A X |
| 4,311,312 | 1/1982 | O'Brien | 273/195 A |
| 5,110,133 | 5/1992 | Durso | 273/195 A |
| 5,163,686 | 11/1992 | Bergman | 273/187 A |
| 5,333,875 | 8/1994 | Wilson | 273/187.1 |
| 5,340,109 | 8/1994 | Miller | 273/186.1 |
| 5,342,052 | 8/1994 | Bloomington | 273/167 H |

FOREIGN PATENT DOCUMENTS

| | | | |
|---|---|---|---|
| 281099 | 12/1927 | United Kingdom | 273/186.4 |

*Primary Examiner*—George J. Marlo
*Attorney, Agent, or Firm*—William H. Maxwell

[57] ABSTRACT

Apparatus for determining a golfer's stance with respect to a turf simulating surface and for determining the direction of lateral forces applied during the golfer's swing by observing the lateral movement of a shiftable member with said turf simulating surface thereon and engaged upon a base member for free lateral displacement from a target line on the base member, the stance of the golfer being determined by a placement line on the base member and positioned relative to the target line.

19 Claims, 3 Drawing Sheets

DIAGNOSTIC APPARATUS FOR GOLFCLUB SWING PRACTICE

BACKGROUND OF THE INVENTION

This invention relates to the game of golf and with a primary objective aimed at improving a golfer's swing as it is related to the ball-to-target line of a shot. Regardless of the type of golf club used, each is characterized by a "head" with a flat "clubface" having what is known as a "sweetspot" for optimum face-to-ball impingement. The direction of swing as related to disposition of the target line at the moment of impingement is most important, and the angular relationship of the clubface to the target line is of equal importance. These two factors of importance are to be controlled by the golfer in order to choose his golf shots as circumstances require, and those shots to be controlled are generally as follows:

A "straight" shot is the basic shot from which all other shots deviate and is an optimum shot when the swing is in alignment with the ball-to-target line and with the clubface square to the target line.

A "fade" is the result of an out-to-in swing with the clubface square to the target line, in which case the ball starts to the left and then fades to the right. When you hit a fade shot, the ball is struck left of the target but then travels to the right during flight, a controllable shot that moves the ball from left to right during flight. Therefore, the fade is a useful shot for playing around hazards.

A "draw" is the result of an in-to-out swing with the clubface square to the target line, in which case the ball goes to the left and fades to the left. The draw is a useful shot for playing around a hazard, and it increases the distance of a shot because the ball rolls on landing. It involves the spin of the ball in the air.

The "slice" is usually associated with a bad shot, one that curves wildly to the right, but a shot that can be used to advantage, and it comes from an out-to-in swing path with an "open" outwardly turned clubface. The slice arises from a number of different conditions, such as the result of grip, body stance, ball position, and clubface angle. These conditions are usually corrected or can be changed, by a relaxed grip, a different stance such as one aligned parallel with the target line, and by a different or squarely positioned clubface.

The "hook" is one of the most destructive unintentional shots, but can be used deliberately to advantage since it has a pronounced right to left shape useful in escaping a hazard.

A perfect "stance" and "lie" is not always possible since there are a variety of hazards, such as sloping lies, playing from the rough, edge shots and bunker shots, and other awkward situations, and various other recognized problem shot which are detrimental but correctable, and which are often used to advantage.

This invention provides golfers with the ability to diagnose their club swing dynamics, for indoor as well as outdoor practice, with or without a golf ball, in order to perfect stance and swing habits. Golf is a complex of physical and mental habit. For example, there is a tendency for the golfer to lift his head and shoulders during the golfclub swing ( in order to follow the ball ), often causing the club to miss the ball. It is an object of this invention to make the golfer aware of the clubface disposition relative to an optimum square dispostion to the ball-to-target line at the time of impact or impingement with the ball. There is also the problem of a poor lie, (or terrain), which cannot be changed because it is the existent surface of the golf course terrain. Controlling the golfer's swing and clubface disposition requires practice in or der to develope automatic muscle memory with respect to good swing habits, Accordingly, it is an object of this invention to provide an apparatus by which the golfer is made conscious of his swing results as related to the aforesaid recognized golf shots, so that they can be modified and employed to advantage.

The above recognized golf shots are practiced on the apparatus herein disclosed in various ways, with or without a golf club, and with or without a "tee". A factor is the close proximity of the head of the golfclub to the turf over which it swings when striking the golf club. When a golfball lies upon the turf, the bottom edge or surface of the golfclub head comes approximately tangent to the turf surface, and often digs into the turf causing a "duffed" shot to occur. And, when the golfball is supported upon a tee, duffed shots and "divits" are not so likely to occur. However, there is likely to be a touching of the bottom of the head with the turf so as to have frictional engagement therewith, and especially when driving or striking a golfball lying directly upon the turf. Therefore, it is an object of this invention to provide a force responsive means that improves a shiftable member a commensurate displacement in the direction of swing, and also to the angular displacement of the clubface to the ball-to-target line. It is to be understood that the direction of swing can be out-to-in or in-to-out, and that the angle of the clubface can deviate from the ball-to-target line. A feature of the present invention is the force responsive means that moves the shiftable member right or left in response to an out-to-in or in-to-out direction of swing; and additionally to the angular disposition of the clubface to the ball-to-target line. In practice, the force responsive means is either a flexible tee or the depressible surface of the simulated turf. A vector force is applied by the direction of swing and also by the angular disposition of the clubface to the target line.

It is an object of this invention to use a golfclub in combination with the apparatus disclosed herein, to record the out-to-in or in-to-out direction of swing, and to this end a layer of scuff sensitive material is provided and attached to the bottom surface of the clubhead. When the scuff material comes into contact with the turf, it is grooved in the direction of swing motion, and preserved for subsequent diagnostic observation by the golfer. The irregular surface of the simulated turf abrades the scuff material, thereby producing an observable record.

SUMMARY OF THE INVENTION

This is an apparatus for diagnostic analysis by a golfer to determine the effect of his swing capabilities. Stance and club control is involved in order to detect detrimental habits and to correct them, whereby variations can be achieved to great advantage in the sport. The apparatus is basically a platform on which the golfer stands in relation to foot positioning relative to the strike position of the golf ball. There is a swing portion of the apparatus in alignment with a ball-to-target line, and the golfer faces the swing portion and with his two feet placed according to conventionally accepted foot positions, there being a lateral left heel line extending from the strike position of the golf ball, and there being at least one toe line parallel to the target line. In practice, there is a multiplicity of each of said lines as shown. The apparatus shown and described is reversible for right and left handed golfers, and is described herein as it is used by right handed golfers.

In accordance with this invention, there is a shiftable member frictionally supported on a base member that forms the platform, and this member is shiftable from the target line, and it has a simulated turf surface that is engageable by the bottom surface of the clubhead. A feature is a force responsive means at the surface of the turf and which takes one of two forms, or both. The first and preferred form of force responsive means is a flexible tee upon which the golf ball may or may not be placed for support. The second form of force responsive means is artificial turf that is frictionally engaged by the bottom face of the clubhead. The artificial or simulated turf is engaged by the lower edge of the clubhead during the strike of a normal swing. Note, if the tee is not engaged, the swing is too high. In other words, the golfer must strike the tee in order to obtain a forceful reaction therefrom.

The force responsive means responds to swings misaligned with the ball-to-target line and/or angular displacement of the golfclub head, either or both of which cause lateral movement away from the target line, to the left or to the right. The magnitude of movement from the target line is the golfer's clue to his control ability, by direction and degree of movement of said member.

The foregoing and various other objects and features of this invention will be apparent and fully understood from the following detailed description of the typical preferred forms and application thereof, throughout which description reference is made to the accompanying drawings.

THE DRAWINGS

Figures 3A, 3B, 3C:
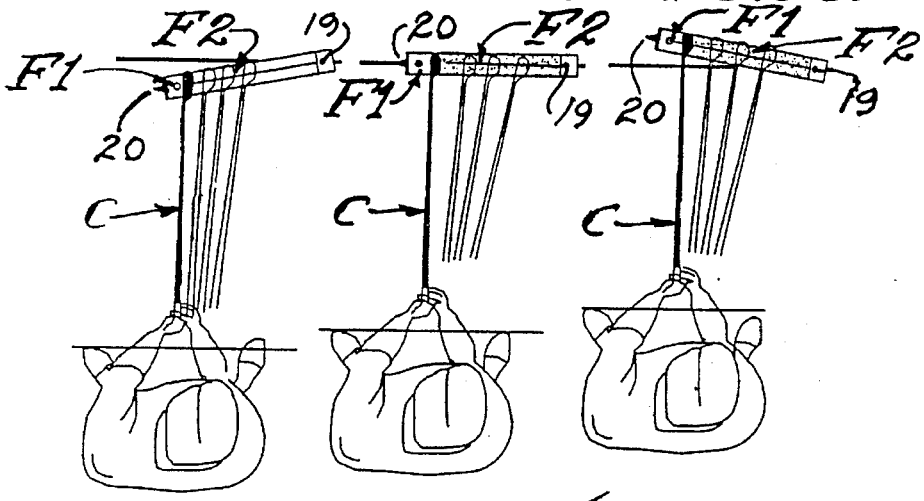

FIGS. 3*a*, 3*b* and 3*c* are top views of a golfer's three basic stances, namely foot positions for a "fade" shot in FIG. 3*a*, foot positions for a "straight" shot in FIG. 3*b*, and foot positions for a "draw" shot in FIG. 3*c*, the results of said shots being shown by the displacement of the shiftable member in each instance.

Figure 4:
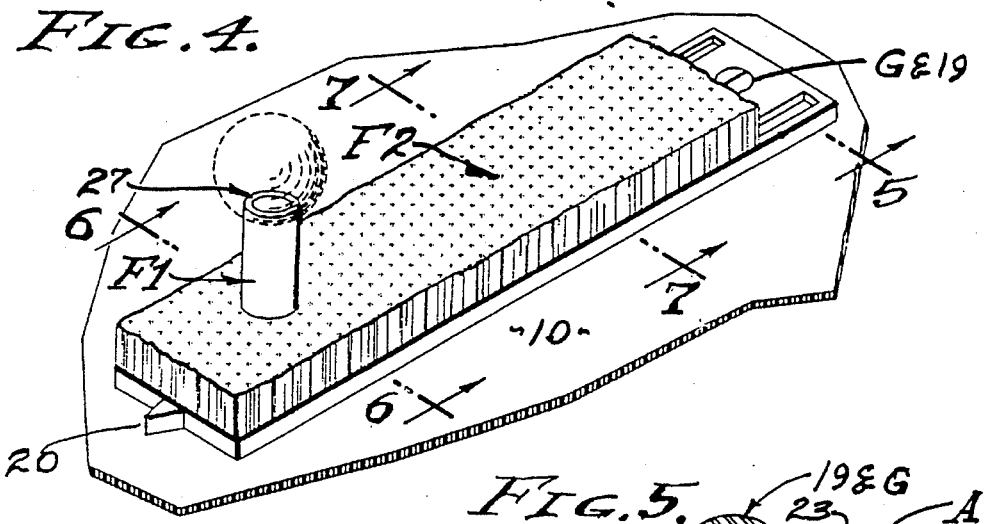

FIG. 4 is a perspective view of the shiftable member and the force responsive means (two forms of said means ) and showing ball position and tee installation.

Figure 5:
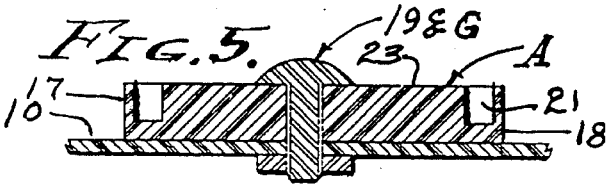
Figure 6:
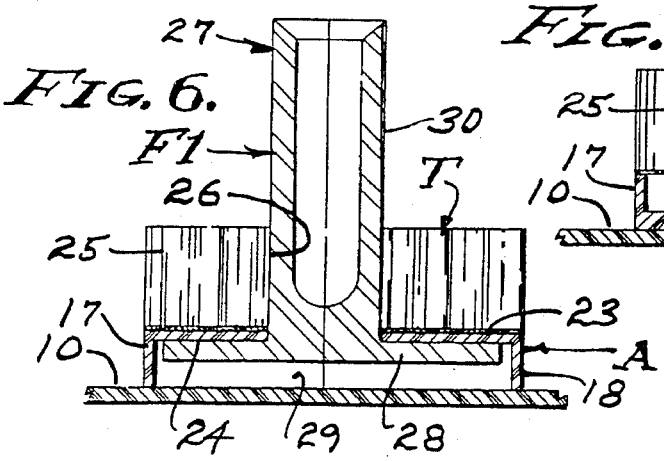
Figure 7:
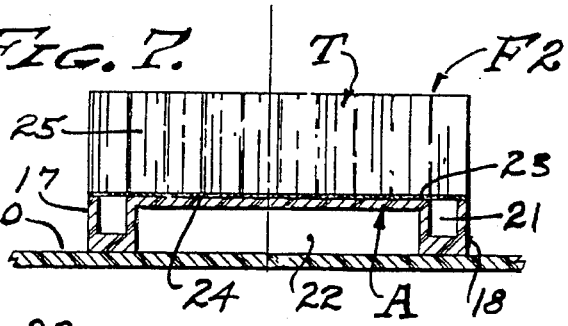

FIGS. 5, 6 and 7 are sectional views taken as indicated by lines 5—5, 6—6 and 7—7 on FIG. 4, FIG. 5 showing mounting of the shiftable member to a base member, FIG. 6 showing the shiftable member and ball position with a tee for placement of the ball, and FIG. 7 showing a typical cross section of the shiftable member and simulated turf which functions as a form of force responsive means.

Figure 8:
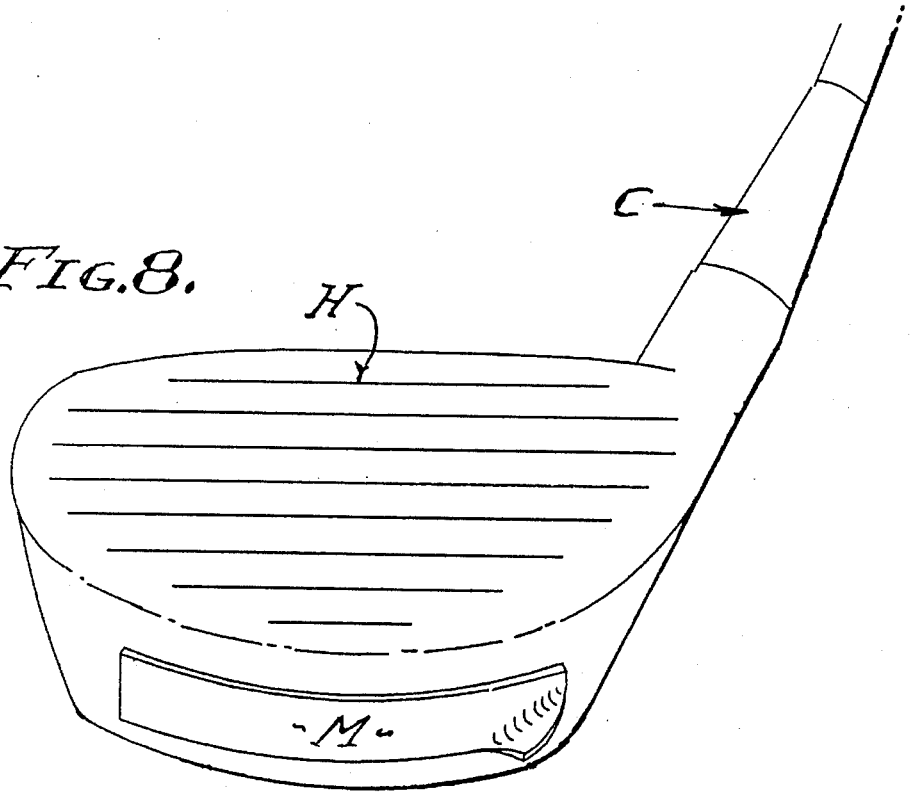
Figure 9:
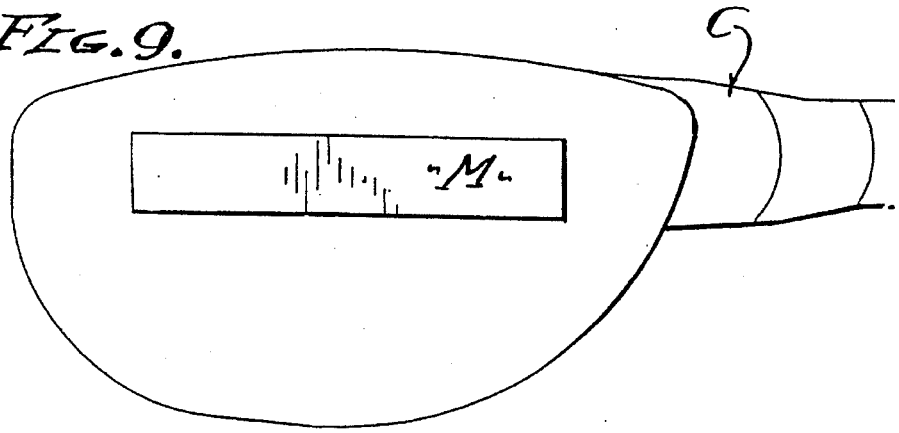

FIG. 8 is a perspective view of a typical driver clubhead, with scuff sensitive material attached to the bottom face of the clubhead. FIG. 9 is an illustration of a perfect strike, where the bottom face of the clubhead wipes over the turf and is subject to abrasion.

Figure 10:
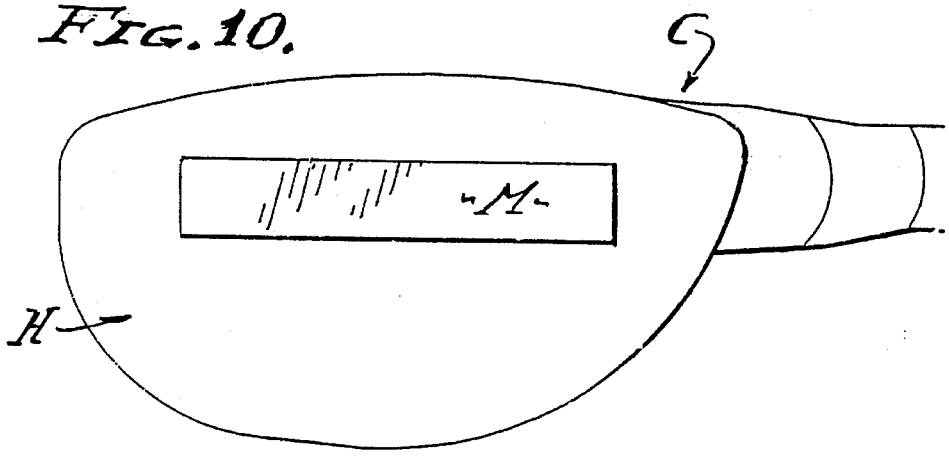

And, FIG. 10 is a bottom view of a clubhead that has been abraded during the execution of a "fade" stroke, the scuff sensitive material being abraded diagonally as shown.

PREFERRED EMBODIMENT

Referring now to the drawings, the apparatus herein disclosed involves a golf practice platform P and a golfclub C that are cooperatively employed by the golfer to perfect his swing by assuming a corrected stance. The apparatus accepts persons of varied stature and capability, the primary purpose being to diagnose one's deficiencies and abilities through analysis of hand-on results under actual conditions. That is, this apparatus can be used on the golfcourse as well at home, with or without a golfball and/or tee. The turf is simulated and actual golfballs can be used. Therefore, the analyses attained are empirically correct, it being an object to detect and/or create variations from a perfect strike or any particular stroke which the golfer chooses to employ to his advantage.

Generally, the golf practice platform P involves a base B having a swing portion 10 and a golfer's stance portion 11, there being a shiftable member A carried on the base to be moved by force responsive means F1 or F2, or both, in response to engagement by the golf club head H during the golfer's swing. It is all important that the golfer's stance with respect to the position of the golf ball be correct for him to execute the stroke and to obtain the particular golfshot desired; and to this end there is at least one foot positioning line associated with the golf ball position and preferably two such lines, at least one line L1 for placement of the left foot in the direction of the ball-to-target line L, and at least one line L2 for placement of the feet in relation to the target. The results of each swing is recorded , when desired, upon a film M attached to the bottom of the golf club head H.

Figure 1:
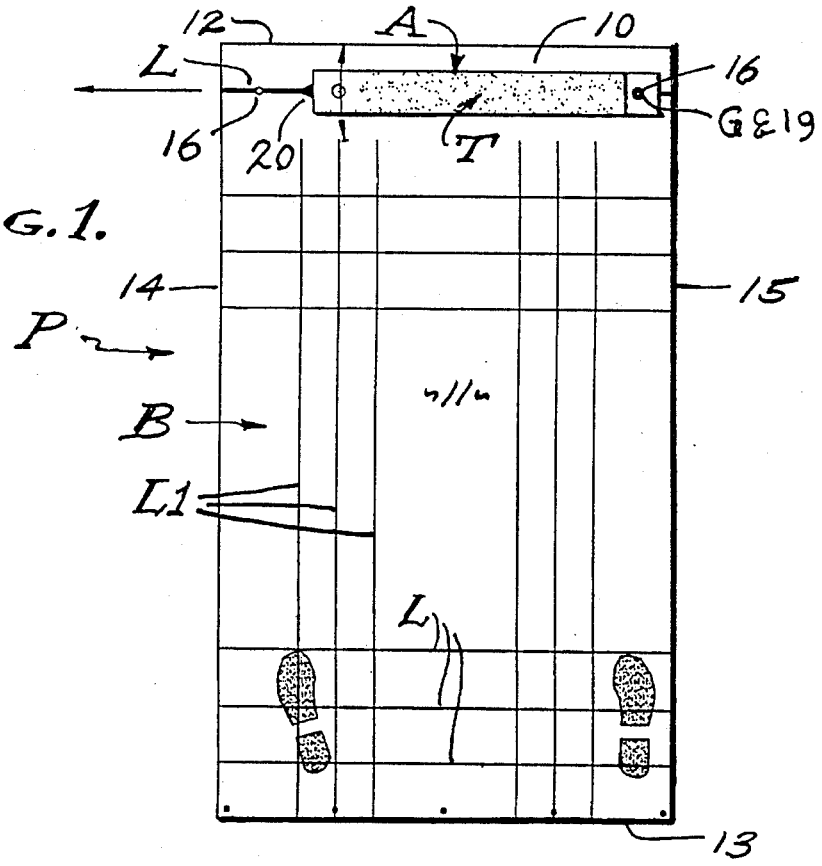
FIG. 1 is a plan view the Diagnostic Apparatus showing the preparatory placement of the shiftable member and force responsive means, and shown as an example of foot placement with respect to the foot placement lines for a right-handed golfer.

The base B is an integral planar member shown to have a rectangular plan form about 24 to 36 inches wide in the direction of the ball-to-target line L, and about 40 to 48 inches deep extending laterally of the target line to underlie the golfer. In practice, 0.062 inch sheet plastic material such as high impact polystyrene is employed and sheared to size to have parallel front and back edges 12 and 13, and opposite side edges 14 and 15. The golfer stands upon the back stance portion 11, facing the side of the target line L, the swing portion 10 occupying the front of the base to underlie the target line L that is parallel to the front edge 12. The target line L is conspicuously observable as it extends coextensively between the sides 14 and 15 in the direction of the target (not shown), and right and left pivots or holes 16 are provided at the opposite side of the base B and in alignment with the target line L, for right and left handed golfers. As shown in FIG. 1, one of said pivot holes 16 is used for a right-handed golfer, and in FIG. 2 the other is used for a left-handed golfer. A feature of the base member B is its flat planar top surface, and its flexibility for handling and adaptation to irregular supporting surfaces and terrain.

Figure 2:
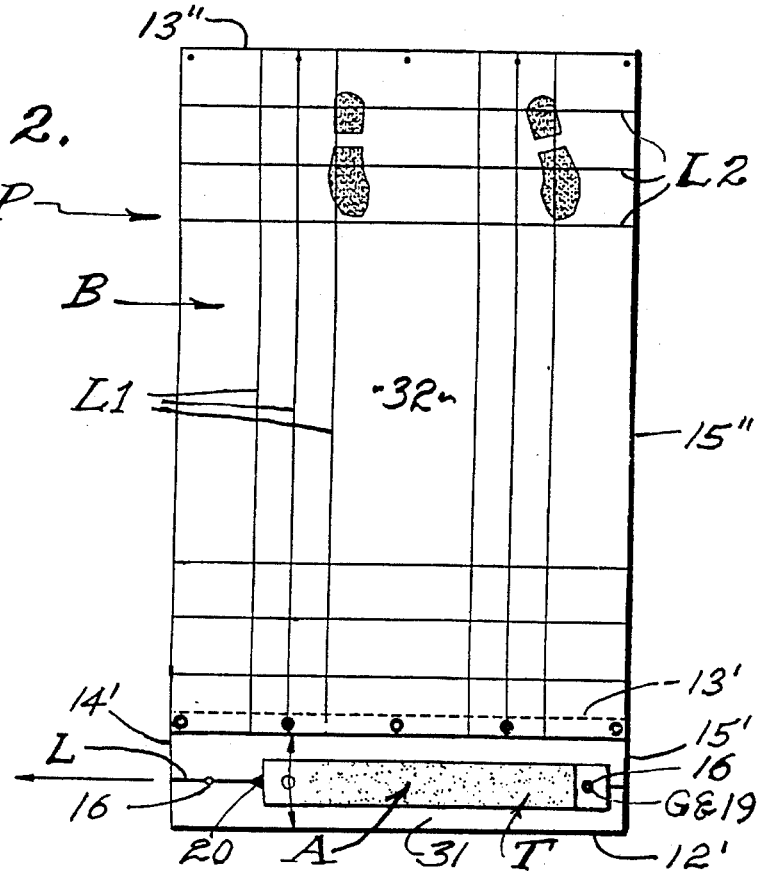
FIG. 2 is a plan view of the opposite side of the apparatus of FIG. 1, showing foot placement lines for use by a left-handed golfer.

In order to facilitate packaging and storage, and also for esthetic acceptance, the platform P is fabricated of two dissimilar materials. As shown in FIG. 2, there are two sections, a swing section 31 and a stance section 32, corresponding to the swing portion 10 and stance portion 11 of the integral platform P hereinabove described. In carrying out this sectional embodiment, the swing section 31 is rectangular, having a front edge 12' and side edges 14' and 15' (see FIG. 2) corresponding to the edges of the first described embodiment ( see FIG. 1). However, the back edge 13' of the swing section is spaced from the target line L a limited distance sufficient to permit normal movement of the shiftable member A as will be described. Accordingly, the swing section 31 is a relatively narrow sheet of stiff plastic material the same as the flexible material of the integral base B, and it presents a smooth low friction surface upon which the shiftable member A slides with uniform impedance.

The stance section 32 of this second embodiment is also rectangular, having a back edge 13" and side edges 14" and 15" (see FIG. 2), corresponding to the edges of the first described embodiment (see FIG. 1). The section 32 is of a dissimilar material than section 31, a material that simulates grass turf in both texture and color. In practice, a pliable artificial turf material with a quarter of an inch pile carried on a heavily woven burlap backing is employed, as manufactured by Argonne Industries. This stance section 32 material is adapted to be wrapped closely around the swing section 31 so as to reduce the configuration of the assembled platfrom P as much as possible. As clearly shown in FIG. 2 of the drawings, the sections 31 and 32 have overlapped margins secured one to the other by a series of low profile fasteners, as for example by rivets or grommets.

The shiftable member A is supported upon the swing portion 10 of the base member B, or upon the swing secton 31, and is adapted to be centered over the ball-to-target line L. In practice, the member A is elongated and somewhat greater in width between its opposite sides 17 and 18 than the length of the bottom surface of a golf club head H, thereby to accommodate said head. And in accordance with this invention, the member A is laterally slidable so as to be forcefully moved from alignment with the target line L. Accordingly, the member A is guided to shift laterally and preferably by means of a pivot so that it is enabled to adapt to out-to-in and in-to-out angles of swing imposed by the golfer's club. As shown therefore, there is a pivotal guide means G in the form of a pin or bolt type fastener 19 anchoring one end of the member A so that it projects free toward the target. The slidable member A extends to a pointer or point 20 short of the side edge 14 of the base member B, and it is this point 20 that is moved into place with the golf club while the golfer is standing preparatory to each practice golfclub swing.

Referring to FIGS. 5 and 7 of the drawings, the shiftable member A has top and bottom channels 21 and 22 for lightness while structurally maintaining beam strength as it slides frictionally upon the planar face of base member B. As shown, the shiftable member A is adapted to be injection molded and has a smooth planar bottom surface subject to being moved easily through the application of lateral in or out force, the coefficient of friction and/or impedance being low.

The top face 23 of the shiftable member A is flat and presents an area to represent a section of turf T extending along the ball-to-target line L as said line extends toward the golf ball position. Any simulating material can be employed when implementing the force responsive means F1 hereinafter described. However, the turf T can be simultaneously employed as the force responsive means F2, in which case it is to closely simulate turf that is frictionally engaged to transfer lateral forces from the golf club head H, when and as they occur. In practice, the turf T is simulated by commercially available artificial turf comprised of a backing 24 with upwardly projecting leaves 25 that simulate blades of grass on which the game of golf is customarily played, such as AstroTurf (Reg. TM) manufactured by Monsanto. The turf backing 24 is cemented or otherwise attached coextensively to the top face 23 of the shiftable member A, and the blades of plastic leaves of polypropylene or the like simulate the turf where the golf swing approaches the golf ball to be impacted.

Referring now to the force responsive means F1, the area next adjacent to the pivot 20 is indented at 26 a short distance from said point (see FIG. 6). The turf T is characterized by closely spaced tufts of leaf blades 25 arranged in rows, and a tuft aligned over the ball-to-target line L is removed by forming a hole in the under-lying backing 24, thereby creating the indentation in the turf. The golf ball can rest in this indentation and is thereby centered over the ball-to-target line L. The initial "drive" of the ball down the "fairway" is from a tee, and accordingly a tee 27 is installed at and through the indentation to project above the artificial turf T for support of the ball to be impacted and driven by the golf club. The tee 27 is comprised of a flanged base 28 received in a downwardly open socket 29 in the shiftable member A, and an upwardly projecting tubular post-like member 30 integral with the base. The top of the member 30 is truncated in a plane normal to its vertical axis, whereby a golf ball centers itself in the open end of said tubular member. In accordance with this invention, the tee 27 is of injection molded rubber-like plastic such as polypropylene, so as to be highly durable and resilient to high impact forces.

Force is generated by the golf club head H during the golf club swing and is applied at the moment of impact with the golf ball. A primary force is exerted by the golfclub in the direction of swing as shown in FIGS. 3*a*, 3*b* and 3*c*, and a secondary lateral force is exerted as the result of an out-to-in, or an in-to-out (an open or closed)clubface as will be indicated by the diagonal scuff mars shown in FIG. 10. FIG. 3*a* illustrates a "fade" shot where the golf club head H swing line a is out-to-in, in which case a primary inward force is imposed upon the tee post 30, moving it and the shiftable member A laterally toward the golfer a distance commensurate with the force applied and/or in alignment with the direction of golf club swing line a.

FIG. 3*b* illustrates a "straight" shot where the golf club head H swing line b is coincidental with the ball-to-target line L, in which case there is no lateral primary force applied upon the tee post 30 and it and the shiftable member A remain unmoved and in alignment with the golf club swing line b and target line L.

FIG. 3*c* illustrates a "draw" shot where the golf club head H swing line c is in-to-out, in which case an outward primary force is imposed upon the tee post 30, moving it and the shiftable member A laterally away from the golfer a distance commensurate with the force applied and/or in alignment with the direction of golf club swing line c.

A secondary lateral force occurs when the golf club head H is rotated (not square) to face either open or closed with respect to the swing lines a, b and c, in which case the face of the golf club head H has a cam effect upon the golf ball and/or upon the tee post 30 to influence its movement right or left. The greater the angular displacement of the golf club head face from the ball-to-target line L, the greater is the movement of the tee 30 when struck thereby.

A feature of the force response means F1 is that the tee post 30 is flexible and elastic and thereby adapts to deflection upon clubhead impact and returns to its original configuration thereafter. Accordingly, the tee transmits force to move the shiftable member A. It is to be understood that the lower edge and bottom surface of the golf club head travels beneath the golf ball so as to engage the top end portion of the tee post 30, to forcefully influence its position with respect to the ball-to-target line L.

Referring now to the force responsive means F2, the coextensive top area of the artificial turf T is responsive to the force of the golf club head H during contact thereby of the swing closely preceeding impact with the golf ball. As hereinabove described, the leaves 25 of the artificial turf grass are flexible and elastic, similar to the physical properties of the aforesaid tee post 30, whereby both primary and secondary lateral forces are responded to in order to move the shiftable member A commensurably.

Referring now to the foot positioning lines L1 and L2, these lines are quite necessary to establish the golfer's stance as circumstances require. Each golfer develops his own techniques, having to do with his stature and physical capabilities. The basic line L1 emanates from the golf ball placement or tee position on the target line and extends toward the golfer at a right angle to the ball-to-target line L, and as shown there are incrementally spaced parallel lines L1 ahead of and behind the centered line, for placement of the golfer's left foot, and usually the heel thereof. Lines L2 cross lines L1 and are spaced from and extend parallel to the ball-to-target line L, and as shown there are incrementally spaced parallel lines L2 for placement of the golfer's feet spaced from the ball-to-target line L, and usually the toe positions of each foot. The placement of the golfer's feet become known as they are positioned with respect to lines L1 and L2, and the results of practice swings observed and analyzed by the movement of the point 20 with respect to the ball-to-target line L, and by the direction of the scuff marks abraded into the film M attached to the bottom surface of the golf ball head H.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A diagnostic apparatus for golf club swing practice to determine the extent of any lateral forces applied during a swing at a golf ball position thereon, and including;

a platform comprised of a planar base member having a swing portion with a ball-to-target line, and having a stance portion for a golfer facing the swing portion, a shiftable member with a turf simulating surface and frictionally engaged upon the base for free lateral displacement from said target line, a golf club engageable force responsive means at the turf simulating surface of the shiftable member, at least one foot placement line on the stance portion of the base member, said placement line being placed with respect to said target line and said ball position, whereby the golfer's stance with respect to the turf simulating surface of the shiftable member is determined by the placement of the golfer's feet in a known proximity to at least one placement line, and by observing any lateral movement of the shiftable member after a golf club swing as may be caused by forceful engagement of the golf club head with the force responsive means.

2. The diagnostic apparatus for golf club swing practice as set forth in claim 1, wherein at least one placement line extends from the golf ball position and laterally at a right angle to the ball-to-target line, and onto the stance portion of the base member as a reference for positioning the one foot of the golfer.

3. The diagnostic apparatus for golfclub swing practice as set forth in claim 1, wherein at least one placement line is spaced from and extends parallel to the ball-to-target line, and onto the stance portion of the base member for positioning the toes of the golfer's feet.

4. The diagnostic apparatus for golfclub swing practice as set forth in claim 1, wherein the planar base member has a smooth top surface and the shiftable member has a smooth bottom surface slideable upon the top surface of the base member.

5. The diagnostic apparatus for golfclub swing practice as set forth in claim 1, wherein the planar base member has a front edge and opposite side edges defining the swing portion thereof, the ball-to-target line being parallel to the front edge and extending to one side edge.

6. The diagnostic apparatus for golfclub swing practice as set forth in claim 1, wherein the planar member has a front edge and opposite side edges defining the swing portion thereof, there being a pivot at one side edge to which the shiftable member is rotatably held by a fastener.

7. The diagnostic apparatus for golfclub swing practice as set forth in claim 1, wherein the planar member has a front edge and opposite side edges defining the swing portion thereof, the ball-to-target line being parallel to the front edge and extending to one side edge, there being a pivot at the other side edge and in alignment with the ball-to-target line, and wherein the shiftable member is elongated with a pointer at one end to align with and be displaced from said target line and the other end rotatably held by a fastener to said pivot.

8. The diagnostic apparatus for golfclub swing practice as set forth in claim 1, wherein the force responsive means is an upstanding member projecting from the turf simulating surface of the shiftable member.

9. The diagnostic apparatus for golfclub swing practice as set forth in claim 1, wherein the force responsive means is a golf tee projecting above the turf simulating surface of the shiftable member.

10. The diagnostic apparatus for golfclub swing practice as set forth in claim 1, wherein the force responsive means is a removable tee projecting above the turf simulating surface comprised of artifical blades of grass.

11. The diagnostic apparatus for golfclub swing practice as set forth in claim 1, wherein the turf simulating surface is comprised of tufts of artificial blades of grass, at least one of said tufts being removed at the golf ball position thereon for placement of a golf ball on the shiftable member.

12. The diagnostic apparatus for golfclub swing practice as set forth in claim 1, wherein the shiftable member is an elongated channel shaped member with a flat top face with a turf simulating surface attached.

13. The diagnostic apparatus for golfclub swing practice as set forth in claim 12, wherein the shiftable member is an elongated channel shaped member with a flat top face with a turf simulating surface replaceably attached.

14. The diagnostic apparatus for golfclub swing practice as set forth in claim 1, wherein the shiftable member is a flat member with a top face supporting the turf simulating surface comprised of tufts of artifical blades of grass.

15. The diagnostic apparatus for golfclub swing practice as set forth in claim 1 , wherein the shiftable member is a flat member with a top face supporting the turf simulating surface comprised of tufts of artificial blades of grass, there being a ball position hole therethrough for the removal and replacement of a golf tee.

16. The diagnostic apparatus for golfclub swing practice as set forth in claim 1, wherein the shiftable member is a flat member with a top face supporting the turf simulating surface comprised of tufts of golf ball blades of grass, and a bottom face with a socket and ball position hole therethrough for the reception of a golf tee projecting above the turf simulating surface.

17. The diagnostic apparatus for golfclub swing practice as set forth in claim 1, wherein the platform is sectional, there being a swing section of stiff material providing the swing portion with the ball-to-target line and for support of the shiftable member, and there being a stance section of pliable material providing the stance portion with the at least one foot placement line, whereby the stance section is adapted to be wrapped around the swing section for compactness.

18. The diagnostic apparatus for golfclub swing practice as set forth in claim 1, wherein the platform is sectional, there being a swing section of stiff material providing the swing portion with the ball-to-target line and for support of the shiftable member, and there being a stance portion with the at least one foot placement line, the swing section and stance section having overlapped margins secured together by a series of low profile fasteners, whereby the stance section is adapted to be wrapped around the swing section for compactness.

19. A cooperative diagnostic apparatus and golf club combination for golf club swing practice to determine the extent of any lateral forces applied during a swing at a golf ball position thereon, and including;

a platform comprised of a planar base member having a swing portion with a ball-to-target line, and having a stance portion for a golfer facing the swing portion, a shiftable member with a turf simulating surface and frictionally engaged upon the base for free lateral displacement from said target line, a golf club engageable force responsive means at the turf simulating surface of the shiftable member, at least one foot placement line on the stance portion of the base member, said placement line being placed with respect to said target line and said ball position, a golf club with a head having a bottom surface engageable with the turf simulating surface and having a film of scuff material attached to said bottom to be abraded by the turf simulating material during the golf club swing, whereby the golfer's stance with respect to the turf simulating surface of the shiftable member is determined by the placement of the golfer's feet in a known proximity to at least one placement line, and by observing any lateral movement of the shiftable member after a golf club swing as may be cause by forceful engagement of the golf club head with the force responsive means, and with respect to the direction of swing by observing direction of abrasion said film after said golf club swing.

* * * * *